US012752213B2

(12) United States Patent
Li

(10) Patent No.: US 12,752,213 B2
(45) Date of Patent: Oct. 6, 2026

(54) BUBBLE BLOWING DEVICE

(71) Applicant: Zhijiang Li, Shenzhen (CN)

(72) Inventor: Zhijiang Li, Shenzhen (CN)

( * ) Notice: Subject to any disclaimer, the term of this patent is extended or adjusted under 35 U.S.C. 154(b) by 166 days.

(21) Appl. No.: 18/900,841

(22) Filed: Sep. 29, 2024

(65) Prior Publication Data

US 2026/0061333 A1 Mar. 5, 2026

(30) Foreign Application Priority Data

Sep. 2, 2024 (CN) ..... 202422147412.X

(51) Int. Cl.
*A63H 33/28* (2006.01)

(52) U.S. Cl.
CPC ..... *A63H 33/28* (2013.01)

(58) Field of Classification Search
CPC ..... A63H 33/28
USPC ..... 446/16
See application file for complete search history.

(56) References Cited

U.S. PATENT DOCUMENTS 3,100,947 A * 8/1963 Hellman ..... A63H 33/28 446/16
4,447,982 A * 5/1984 Gushea ..... A63H 33/28 446/16
4,775,348 A * 10/1988 Collins ..... A63H 33/28 446/16
11,684,868 B2 * 6/2023 Chan ..... A63H 33/28 446/15
12,196,290 B2 * 1/2025 Kwon ..... F16H 57/082
2003/0082985 A1 * 5/2003 Payne ..... A63H 33/30 446/15
2006/0052027 A1 * 3/2006 Thai ..... A63H 33/28 446/15
2023/0201737 A1 * 6/2023 Xu ..... A63H 33/28 446/15
2025/0025803 A1 * 1/2025 Chen ..... A63H 33/28
2026/0007982 A1 * 1/2026 Cai ..... A63H 33/28
2026/0061333 A1 * 3/2026 Li ..... A63H 33/28

* cited by examiner

*Primary Examiner* — Kristina R Fulton
(74) *Attorney, Agent, or Firm* — JEEN IP LAW, LLC

(57) ABSTRACT

A bubble blowing device is provided, which connects an output shaft of a motor and a bubble mesh by providing with a deceleration mechanism. The deceleration mechanism can slow down and stabilize the speed of the bubble mesh while the output shaft is rotated at a high speed, thereby reducing a vibration phenomenon of the bubble mesh during operation and improving the smoothness and reliability of the bubble blowing device. Furthermore, by providing the deceleration mechanism in an length extension direction of the output shaft, a torque transmission distance between the output shaft and the bubble mesh can be effectively shortened, thereby avoiding a problem of excessive vibration caused by a long torque transmission distance, it can also render the structure of the entire bubble blowing device more compact, which is not only easy to carry, but also saves storage space.

9 Claims, 5 Drawing Sheets

BUBBLE BLOWING DEVICE

CROSS-REFERENCE TO RELATED APPLICATIONS

This application claims priority to Chinese Patent Application No. 202422147412.X, filed on Sep. 2, 2024, which is hereby incorporated by reference in its entirety.

TECHNICAL FIELD

The present disclosure relates to the field of toy technologies, and in particular, to a bubble blowing device.

BACKGROUND

In existing bubble blowing devices, in order to form stable bubbles in the foam liquid, a gear ring is usually set along a circumference of a bubble mesh and connected to a motor through a long rod with gears at both ends for driving. However, this mechanical structure may cause the bubble mesh to shake during an actual operation. This shaking not only affects the stability and aesthetics of bubble formation, but may also cause additional wear and tear on internal components of the device, which will shortens the lifespan of the toy.

In addition, the gear ring that is set along the circumference of the bubble mesh and the driving the gear ring by the gear rod requires more installation space, which may result in a larger volume of the bubble blowing device and poor compactness of the structure.

SUMMARY

The technical problem to be solved by the present disclosure is to provide a bubble blowing device that can solve a problem of vibration of a bubble mesh during rotation and poor compactness of structure.

The present disclosure provides a bubble blowing device, which includes:

a bracket;

a motor, which is provided on the bracket and includes an output shaft;

a bubble blowing mechanism, which includes a fan blade and a bubble mesh; the fan blade is connected to the output shaft, the bubble mesh is movably provided on the bracket;

a pumping liquid mechanism, configured to pump liquid to the bubble mesh; and a deceleration mechanism, which is provided in a length extension direction of the output shaft, the deceleration mechanism is located between the fan blade and the bubble mesh; one end of the deceleration mechanism is connected to the output shaft, and the other end of the deceleration mechanism is connected to the bubble mesh.

In some embodiments of the present disclosure, the deceleration mechanism includes an eccentric wheel, a driving ring gear, and a driven ring gear; the eccentric wheel, the driving ring gear, and the driven ring gear are all located in the length extension direction of the output shaft;

the eccentric wheel is connected to the output shaft, the driving ring gear is provided on the eccentric wheel, the driven ring gear is provided on the bubble mesh, the driving ring gear is located inside the driven ring gear and meshes with the driven ring gear.

In some embodiments of the present disclosure, a limiting portion is provided on the driving ring gear, a limiting hole is provided on the bracket, the limiting portion is inserted into the limiting hole, and the limiting hole is configured to limit the limiting portion.

In some embodiments of the present disclosure, the deceleration mechanism includes a sun gear, a planetary gear, a carrier, and a fixed gear ring; the sun gear is sleeved on the output shaft, the planetary gear is rotatably provided on the carrier, the carrier is connected to the bubble mesh, the fixed gear ring is provided on the bracket, and the planetary gear meshes with the sun gear and the fixed gear ring respectively.

In some embodiments of the present disclosure, the sun gear is provided on the fan blade.

In some embodiments of the present disclosure, the deceleration mechanism includes three planetary gears, each of which is respectively provided on the carrier, the sun gear meshes with each of the three planetary gears, and each of the three planetary gears meshes with the fixed gear ring.

In some embodiments of the present disclosure, at least one insertion shaft is provided on the carrier, and each of the at least one insertion shaft is provided with the planetary gear.

In some embodiments of the present disclosure, the deceleration mechanism further includes an eccentric wheel, a driving ring gear, and a driven ring gear; the eccentric wheel, the driving ring gear, and the driven ring gear are all located in the length extension direction of the output shaft; the eccentric wheel is provided on the carrier, the driving ring gear is provided on the eccentric wheel, the driven ring gear is provided on the bubble mesh, the driving ring gear is located inside the driven ring gear, and the driving ring gear meshes with the driven ring gear;

when the carrier drives the eccentric wheel to rotate, the eccentric wheel drives the driving ring gear to rotate, so that the driving ring gear drives the bubble mesh to rotate through the driven ring gear.

In some embodiments of the present disclosure, the deceleration mechanism further includes a connection seat, which is inserted into the bubble mesh; a surface of the connection seat away from the bubble mesh is provided with an avoidance groove, and the driven ring gear is integrally formed and provided in the avoidance groove.

In some embodiments of the present disclosure, the pumping liquid mechanism includes a liquid pump and a liquid distribution plate; the liquid pump is provided on the bracket, and the liquid pump is connected to the motor; the liquid distribution plate is provided between the fan blade and the bubble mesh, and the liquid distribution plate is provided with a liquid guide hole; the liquid pump is connected to the liquid distribution plate, the fixed gear ring is provided on the liquid distribution plate;

at least one clamping part is provided on the liquid distribution plate, at least one clamping hole is provided on the bracket; each of the at least one clamping part is correspondingly clamped to each of the at least one clamping hole.

The embodiments of the present disclosure have the following beneficial effects.

The present disclosure relates to a bubble blowing device, which connects an output shaft of a motor and a bubble mesh by providing with a deceleration mechanism, effectively solving a problem of vibration of the bubble mesh during rotation. Specifically, the deceleration mechanism can slow down and stabilize the speed of the bubble mesh while the output shaft is rotated at a high speed, thereby reducing a vibration phenomenon of the bubble mesh during operation and improving the smoothness and reliability of the bubble blowing device.

Furthermore, by providing the deceleration mechanism in the length extension direction of the output shaft, a torque transmission distance between the output shaft and the bubble mesh can be effectively shortened, thereby avoiding the problem of excessive vibration caused by a long torque transmission distance and further improving the smoothness and reliability of the product during operation; on the other hand, it can also render the structure of the entire bubble blowing device more compact, which is not only easy to carry, but also saves storage space.

BRIEF DESCRIPTION OF DRAWINGS

A more detailed description of the exemplary embodiments of the present disclosure is provided by combining the accompanying drawings, the above and other objectives, features, and advantages of the present disclosure will become more apparent. In exemplary embodiments of the present disclosure, same reference numerals usually represent the same components.

DESCRIPTION OF EMBODIMENTS

The implementation mode of the present disclosure will be described in more detail below with reference to the accompanying drawings. Although the embodiments of the present disclosure are shown in the accompanying drawings, it should be understood that the present disclosure can be implemented in various forms and should not be limited by the embodiments described herein. On the contrary, these embodiments are provided to render the present disclosure more thorough and complete, and to fully convey the scope of the present disclosure to those skilled in the art.

It should be understood that although terms "first", "second", "third", etc. may be used in the present disclosure to describe various information, these terms should not be limited to them. These terms are only used to distinguish information of the same type from each other. For example, without departing from the scope of the present disclosure, a first information may also be referred to as a second information, and similarly, the second information may also be referred to as the first information. Thus, the features limited to "first" and "second" may explicitly or implicitly include one or more of these features. In the description of the present disclosure, the meaning of "a plurality of" refers to two or more, unless otherwise specified.

In a description of the present disclosure, it should be understood that terms "length", "width", "up", "down", "front", "rear", "left", "right", "vertical", "horizontal", "top", "bottom", "inside", "outside" and other directional or positional relationships indicated are based on the directional or positional relationships shown in the accompanying drawings, only for the convenience of describing the present disclosure and simplifying the description, and do not indicate or imply that the device or component referred to must have a specific orientation, be constructed and operated in a specific orientation, and therefore cannot be understood as a limitation of the present disclosure.

Unless otherwise specified and limited, terms "installation", "connection to", "connection with", "fixation", etc. should be broadly understood, for example, it can be a fixed connection, a detachable connection, or an integrate connection; it can be a mechanical connection or an electrical connection; it can be directly connected or indirectly connected through an intermediate medium, and it can be a connection within two components or an interaction relationship between two components. For those skilled in the art, the specific meanings of the above terms in the present disclosure can be understood according to the specific situation.

Figure 1:
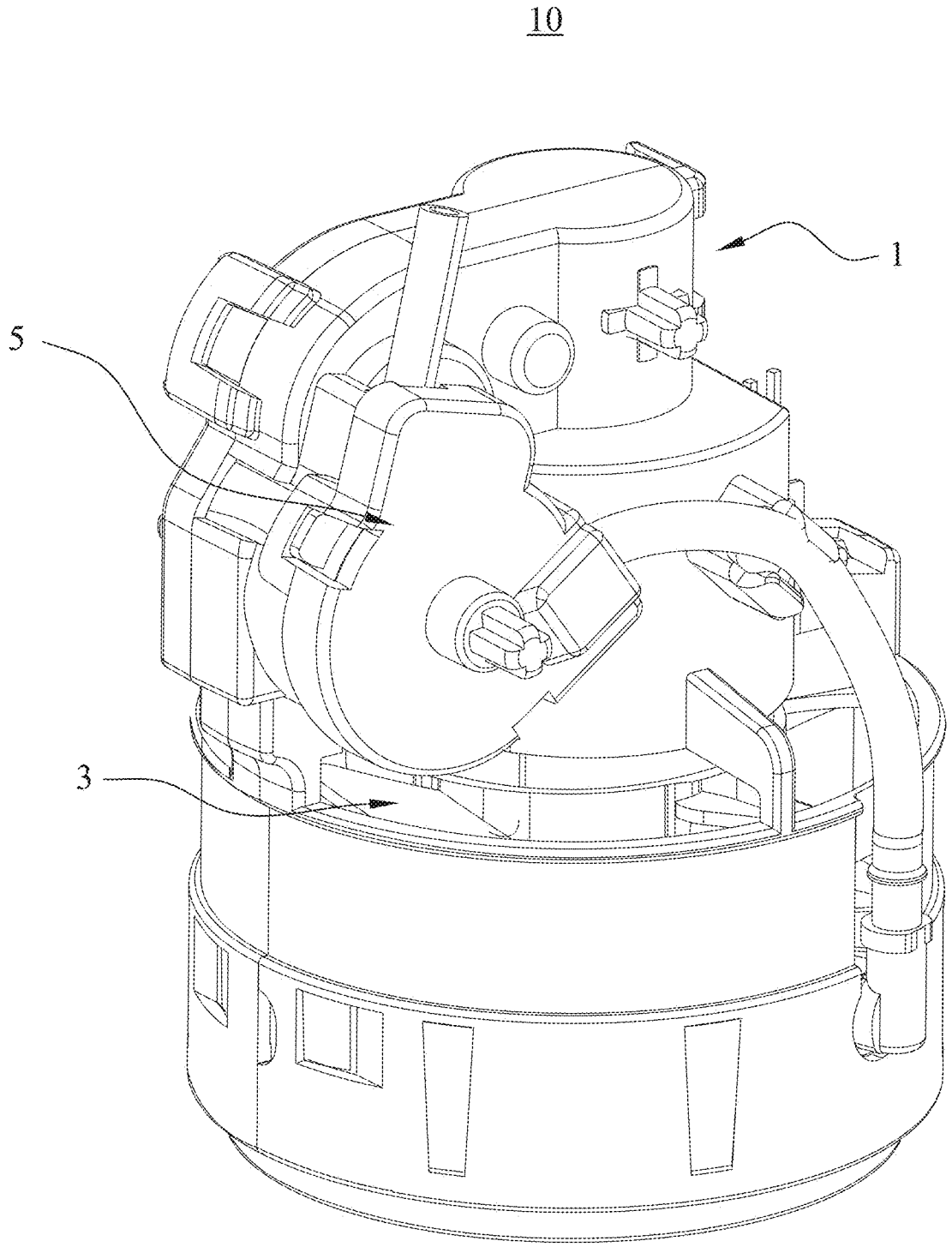
FIG. 1 is a schematic structural diagram of a bubble blowing device in some embodiments of the present disclosure.
Figure 2:
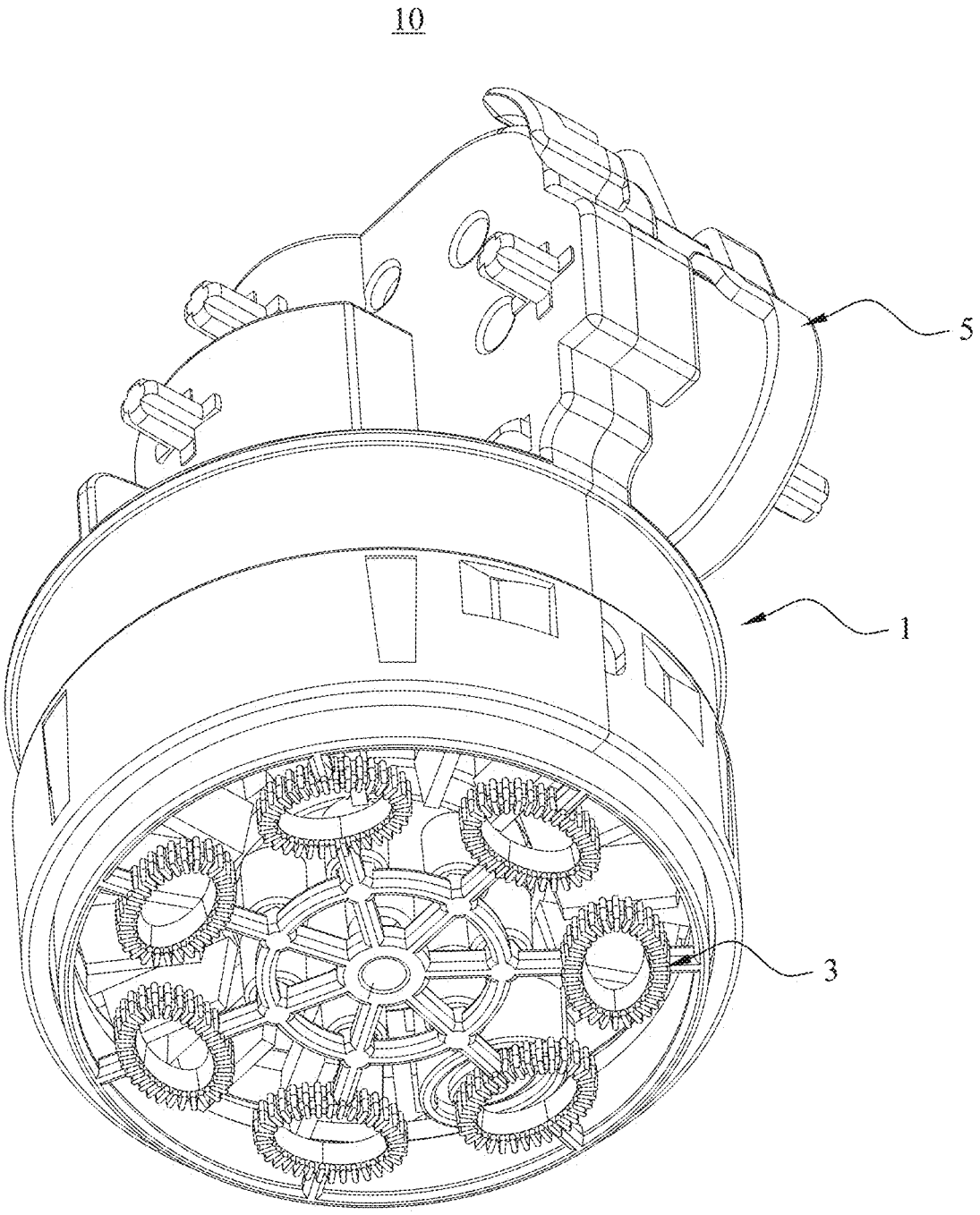
FIG. 2 is a schematic structural diagram of the bubble blowing device shown in FIG. 1 from another perspective view.

FIGS. 1 and 2 show a bubble blowing device 10 in some embodiments of the present disclosure, which is capable of generating bubbles. As shown in FIGS. 1 to 5, the bubble blowing device 10 includes a bracket 1, a motor 2, a bubble blowing mechanism 3, a deceleration mechanism 4, and a pumping liquid mechanism 5. The motor 2, the bubble blowing mechanism 3, the deceleration mechanism 4, and the pumping liquid mechanism 5 are respectively provided on the bracket 1.

It can be understood that the bracket 1 plays a role in supporting and fixing. The motor 2 is used to output a torque. The bubble blowing mechanism 3 is used to generate bubbles. The deceleration mechanism 4 is used to further transmit the torque of the motor 2 to the bubble blowing mechanism 3. The pumping liquid mechanism 5 is used for pumping liquids, such as foam liquid used for generating bubbles.

As shown in FIGS. 1 to 5, the motor 2 is provided on the bracket 1 and has an output shaft 21. The bubble blowing mechanism 3 includes a fan blade 31 and a bubble mesh 32. The fan blade 31 is connected to the output shaft 21, the bubble mesh 32 is movably provided on the bracket 1; the pumping liquid mechanism 5 is used to pump liquid to the bubble mesh 32, and the deceleration mechanism 4 is provided on a length extension direction D1 of the output shaft 21. The deceleration mechanism 4 is located between the fan blade 31 and the bubble mesh 32. One end of the deceleration mechanism 4 is connected to the output shaft 21, and the other end of the deceleration mechanism 4 is connected to the bubble mesh 32. Where, the motor 2 drives the output shaft 21 to rotate, which in turn drives the fan blade 31 to rotate and, through the deceleration mechanism 4, the bubble mesh 32 is driven to rotate.

It can be understood that the bracket 1 is used to fix and install other components, thereby ensuring stability and structural integrity of an entire device. The motor 2 outputs the torque through the output shaft 21. When the motor 2 is working, the output shaft 21 will rotate.

The fan blade 31 is directly connected to the output shaft 21 of the motor 2, and rotated with a rotation of the output shaft 21, thereby generating airflow. The bubble mesh 32 is movably provided on the bracket 1 and indirectly connected to the output shaft 21 through the deceleration mechanism 4.

The deceleration mechanism 4 is located in the length extension direction D1 of the output shaft 21, and provided between the fan blade 31 and the bubble mesh 32. One end of the deceleration mechanism 4 is connected to the output shaft 21, and the other end thereof is connected to the bubble mesh 32. A main function of the deceleration mechanism 4 is to regulate a rotational speed transmitted from the output shaft 21, thereby ensuring that the bubble mesh 32 operates at a stable speed.

It should be noted that when the motor 2 is started, the output shaft 21 begins to rotate, and the fan blade 31 is rotated accordingly, thereby generating airflow. At the same time, the deceleration mechanism 4 converts a high speed of the output shaft 21 into a low speed suitable for an operation of the bubble mesh 32. The advantage of doing so is that, on the one hand, the deceleration mechanism 4 can reduce the vibration of the bubble mesh 32 caused by high-speed rotation, enhancing the stability of the bubble blowing device 10 during operation; on the other hand, through a speed regulation effect of the deceleration mechanism 4, the bubble mesh 32 can rotate at a more uniform speed, which is conducive to forming more stable and continuous bubbles.

In addition, by providing the deceleration mechanism 4 along the length extension direction D1 of the output shaft 21, the entire bubble blowing device 10 has more compact in size, rendering it easier to carry and store. This is particularly important for children's toys, as the smaller size not only facilitates children's operation, but also provides more convenience for families. Specifically, by providing the deceleration mechanism 4 along the length extension direction D1 of the output shaft 21, the output shaft 21 can be connected to the bubble mesh through the deceleration mechanism within a shorter distance, without a need for larger gear rings providing on a circumference of the bubble mesh for torque transmission. At the same time, it eliminates the need for a gear long rod, thus eliminating the need to reserve more space for torque transmission components provided in the circumference direction of the bubble mesh. Thus, an overall volume of the bubble blowing device 10 is smaller and the overall compactness is improved.

Figure 3:
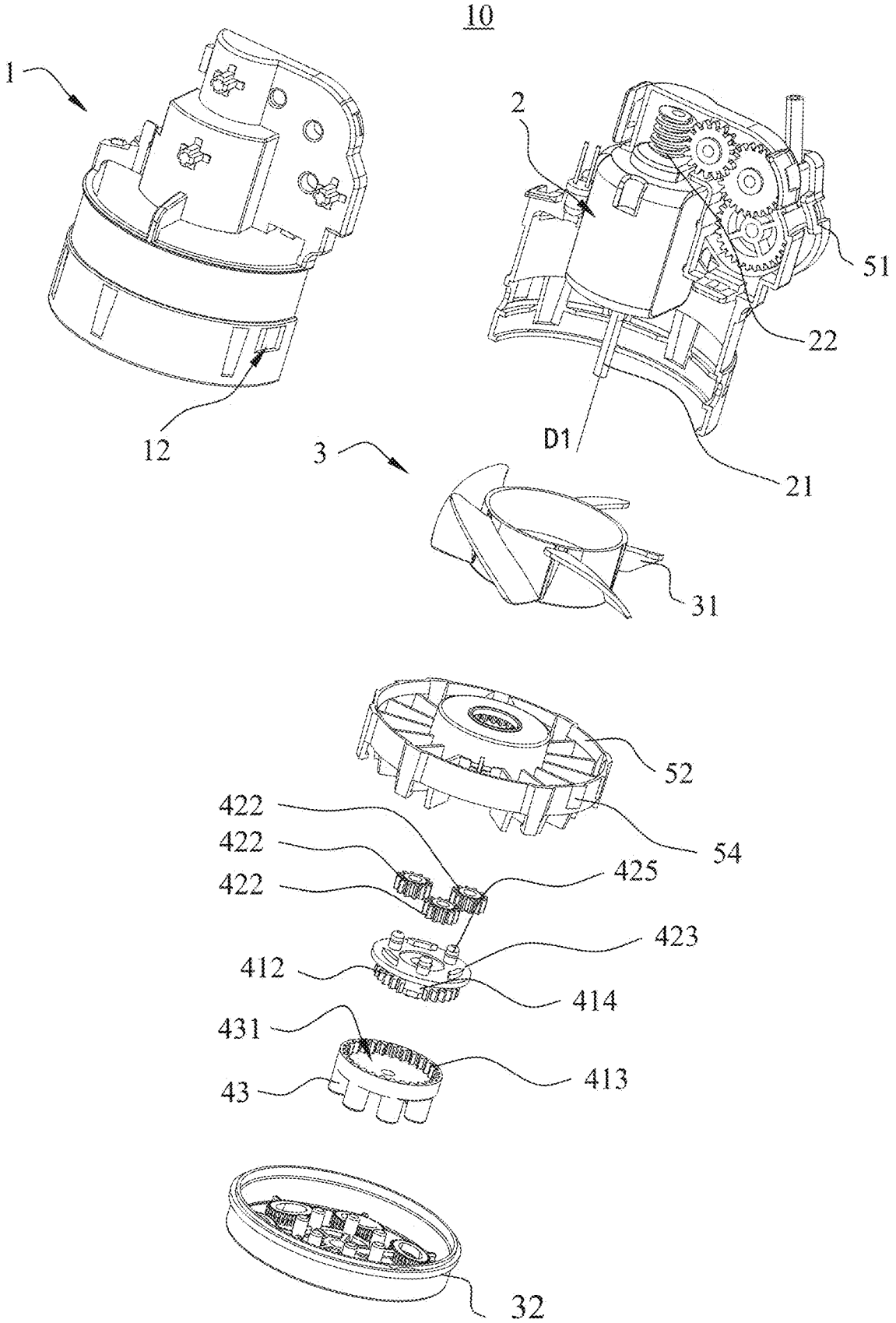
FIG. 3 is an exploded view of the bubble blowing device in some embodiments of the present disclosure.
Figure 4:
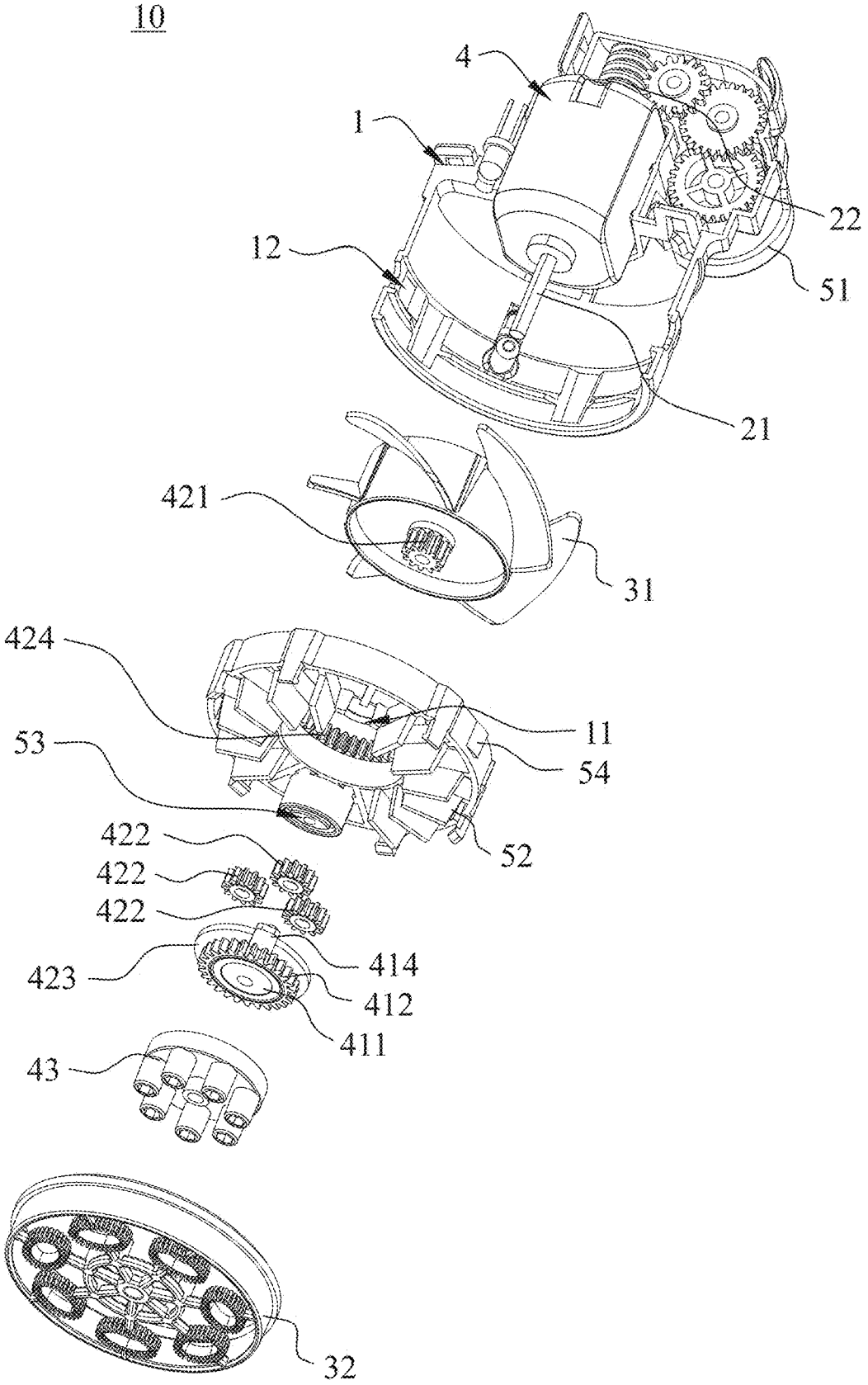
FIG. 4 is an exploded view of the bubble blowing device shown in FIG. 3 from another perspective view.
Figure 5:
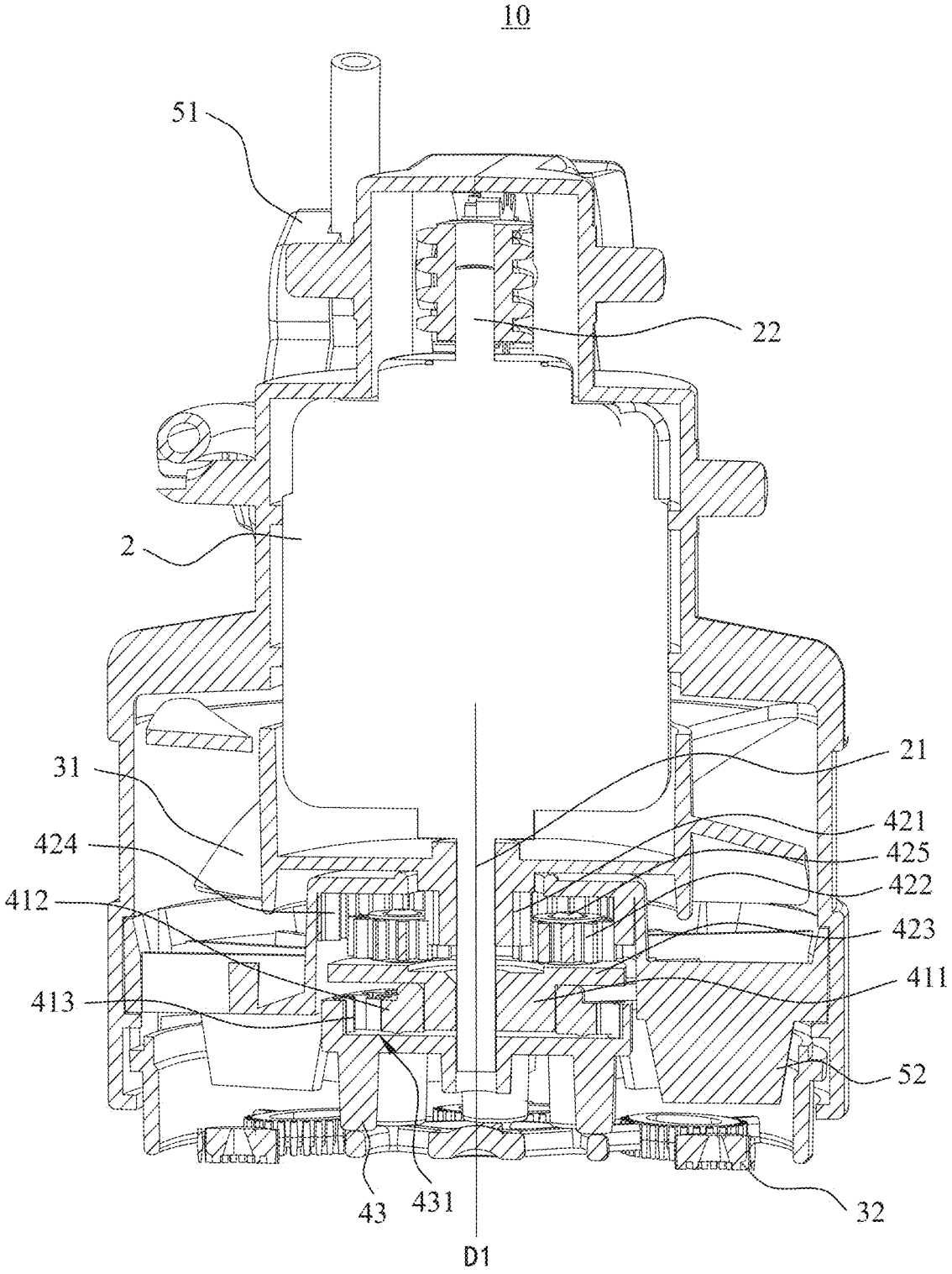
FIG. 5 is a schematic diagram of an internal structure of the bubble blowing device in some embodiments of the present disclosure.

As shown in FIGS. 3 to 5, in some embodiments of the bubble blowing device 10, the deceleration mechanism 4 includes an eccentric wheel 411, a driving ring gear 412, and a driven ring gear 413. The eccentric wheel 411, the driving ring gear 412, and the driven ring gear 413 are all located in the length extension direction D1 of the output shaft 21. The eccentric wheel 411 is connected to the output shaft 21. The driving ring gear 412 is provided on the eccentric wheel 411, and the driven ring gear 413 is provided on the bubble mesh 32. The driving ring gear 412 is located inside the driven ring gear 413, and meshes with the driven ring gear 413. The output shaft 21 drives the eccentric wheel 411 to rotate, and the eccentric wheel 411 drives the driving ring gear 412 to rotate, thereby the bubble mesh 32 being driven to rotate by the driving ring gear 412 through the driven ring gear 413.

It can be understood that the eccentric wheel 411 is directly connected to the output shaft 21. When the motor 2 is started, the output shaft 21 is rotated, the eccentric wheel 411 is driven to rotate synchronously. The driving ring gear 412 is provided on the eccentric wheel 411. As the eccentric wheel 411 being rotated, the driving ring gear 412 is also rotated. The driven ring gear 413 is provided on the bubble mesh 32 and located outside the driving ring gear 412. The driving ring gear 412 meshes with the driven ring gear 413, which means that when the driving ring gear 412 is rotated, it will drive the bubble mesh 32 to rotate through a meshing effect with the driven ring gear 413.

It should be noted that when the motor 2 is started, the output shaft 21 begins to rotate, and the eccentric wheel 411 is driven to rotate. A rotation of the eccentric wheel 411 drives the driving ring gear 412 connected to it to rotate. Due to the meshing between the driving ring gear 412 and the driven ring gear 413, the rotation of the driving ring gear 412 will be transmitted to the bubble mesh 32 through the driven ring gear 413, thereby driving the bubble mesh 32 to rotate.

It should also be noted that the number of teeth on the driving ring gear 412 is less than the number of teeth on the driven ring gear 413. Therefore, when driving the bubble mesh through the driving ring gear 412 and the driven ring gear 413, a deceleration can be achieved.

As shown in FIGS. 3 and 4, in some embodiments of the bubble blowing device 10, a limiting portion 414 is provided on the driving ring gear 412, and a limiting hole 11 is provided on the bracket 1. The limiting portion 414 is movably inserted into the limiting hole 11, and the limiting hole 11 is configured to limit the limiting portion 414.

It can be understood that the limiting portion 414 is movably inserted into the limiting hole 11 on the bracket 1, which can limit a radial displacement of the driving ring gear 412 during rotation, thereby avoiding unnecessary swinging or deviation from a predetermined trajectory during rotation. This not only helps to reduce the vibration that may occur during the rotation of the bubble mesh 32, but also improves the reliability and durability of the entire transmission system.

It should be noted that when the eccentric wheel is rotated, the driving ring gear 412 will always maintain meshing with the driven ring gear 413. During the rotation of the driving ring gear 412, the limiting portion 414 always maintains being partially inserted into the limiting hole 11, and the limiting portion 414 will move to a certain extent under the driving of the driving ring gear 412.

In other embodiments, the limiting hole 11 may be configured to be provided on a liquid distribution plate 52. In this way, a position of the limiting portion 414 can also be limited by a structure that does not undergo positional changes relative to the bracket 1.

As shown in FIGS. 3 to 5, in some embodiments of the bubble blowing device 10, the deceleration mechanism 4 includes a sun gear 421, a planetary gear 422, a carrier 423, and a fixed gear ring 424. The sun gear 421 is sleeved on the output shaft 21, the planetary gear 422 is rotatably provided on the carrier 423, the carrier 423 is connected to the bubble mesh 32. The fixed gear ring 424 is provided on the bracket 1, and the planetary gear 422 meshes with the sun gear 421 and the fixed gear ring 424, respectively.

It can be understood that the output shaft 21 drives the sun gear 421 to rotate, and the sun gear 421 drives the planetary gear 422 to rotate, so that the planetary gear 422 drives the carrier 423 to rotate, and then the carrier 423 drives the bubble mesh 32 to rotate.

The sun gear 421 is sleeved on the output shaft 21 and rotates together with the output shaft 21. The planetary gear 422 is provided on the carrier 423 and can be freely rotated around its own axis. The planetary gear 422 meshes with both sun gear 421 and fixed gear ring 424. The carrier 423 is used to support the planetary gear 422 and connected to the bubble mesh 32. When the planetary gear 422 is rotated, the carrier 423 is also rotated, thereby driving the bubble mesh 32 to rotate. The fixed gear ring 424 is provided on the bracket 1 and meshes with the planetary gear 422, but does not participate in active rotation.

It should be noted that when the motor 2 is started, the output shaft 21 begins to rotate, the sun gear 421 is driven to rotate. The rotation of the sun gear 421 will cause the planetary gear 422 that meshes with it to rotate around its own axis. Due to the simultaneous meshing of the planetary gear 422 with the fixed gear ring 424, the rotation of the planetary gear 422 will drive the carrier 423 to rotate in a circumferential direction of the fixed gear ring 424. The carrier 423 ultimately drives the bubble mesh 32 to rotate, so that foam liquid used to generate bubbles can evenly adhere to the bubble mesh, thereby ensuring the stable and uniform formation of bubbles.

It should also be noted that through the technical solution of this embodiment, the product can achieve a higher reduction ratio with a smaller size, rendering the bubble blowing device 10 being more compact, easy to carry and use. Due to a dual meshing of the planetary gear 422 with the sun gear 421 and the fixed gear ring 424, the entire transmission system is more stable, and reduces the shaking of the bubble mesh 32 during rotation.

As shown in FIGS. 3 to 5, in some embodiments of the bubble blowing device 10, the sun gear 421 is provided on the fan blade 31.

It can be understood that the sun gear 421 is directly installed on the fan blade 31. After the motor 2 is started, the output shaft 21 drives the fan blade 31 to rotate, which in turn drives the sun gear 421 to rotate synchronously. The rotation of the sun gear 421 is transmitted to the bubble mesh 32 through the deceleration mechanism 4, thereby driving the bubble mesh 32 to rotate.

It should be noted that the sun gear 421 is directly installed on the fan blade 31 so as to reduce an intermediate transmission link, rendering the entire torque transmission chain being simpler and reducing a possibility of faults. At the same time, due to an integrated design of the sun gear 421 and the fan blade 31, problems of vibration caused by excessive intermediate transmission links during rotation are reduced, the rotation of the bubble mesh 32 is smoother, the stability and quality of bubble generation are improved.

As shown in FIGS. 3 and 4, in some embodiments of the bubble blowing device 10, the deceleration mechanism 4 includes three planetary gears 422, each of which is rotatably provided on the carrier 423. The sun gear 421 meshes with each of the three planetary gears 422, and each of the three planetary gears 422 meshes with the fixed gear ring 424.

It can be understood that the number of the planetary gear 422 may be set to three so as to allow the product to transmit torque in a multi-point contact manner, resulting in a relatively uniform load on each gear and extending the service life of the entire transmission system.

As shown in FIGS. 3 and 5, in some embodiments of the bubble blowing device 10, at least one insertion shaft 425 is provided on the carrier 423, and each of the at least one insertion shaft 425 is provided with the planetary gear 422.

It can be understood that the number of the insertion shaft 425 is configured to be equal to the number of the planetary gear 422. On the one hand, the insertion shaft 425 is used to support the rotation of the planetary gear 422, and on the other hand, the planetary gear 422 can also drive the carrier 423 to rotate through the insertion shaft 425.

As shown in FIGS. 3 to 5, in some embodiments of the bubble blowing device 10, the deceleration mechanism 4 includes a sun gear 421, a planetary gear 422, a carrier 423, and a fixed gear ring 424. The sun gear 421 is sleeved on the output shaft 21, the planetary gear 422 is rotatably provided on the carrier 423, the carrier 423 is connected to the bubble mesh 32. The fixed gear ring 424 is provided on the bracket 1, the planetary gear 422 meshes with the sun gear 421 and the fixed gear ring 424 respectively. The output shaft 21 drives the sun gear 421 to rotate, which in turn drives the planetary gear 422 to rotate. As a result, the planetary gear 422 drives the carrier 423 to rotate, which in turn drives the bubble mesh 32 to rotate.

In this embodiment, the deceleration mechanism 4 further includes an eccentric wheel 411, a driving ring gear 412, and a driven ring gear 413. The eccentric wheel 411, the driving ring gear 412, and the driven ring gear 413 are all located in the length extension direction D1 of the output shaft 21.

The eccentric wheel 411 is provided on the carrier 423, the driving ring gear 412 is provided on the eccentric wheel 411, the driven ring gear 413 is provided on the bubble mesh 32. The driving ring gear 412 is located inside the driven ring gear 413 and meshes with the driven ring gear 413.

When the carrier 423 drives the eccentric wheel 411 to rotate, the eccentric wheel 411 drives the driving ring gear 412 to rotate, thereby driving the bubble mesh 32 to rotate by the driving ring gear 412 through the driven ring gear 413.

It can be understood that when the motor 2 is stared, a torque shaft 22 and the output shaft 21 of a dual-shaft motor begin to rotate. The torque shaft 22 drives the liquid pump 51 to rotate, and the liquid pump 51 pumps liquid from a storage container to the liquid distribution plate 52. The liquid is evenly distributed onto the bubble mesh 32 through a liquid guide hole 53 on the liquid distribution plate 52. The driving ring gear 412 meshes with the driven ring gear 413.

At the same time, the output shaft 21 drives the fan blade 31 to rotate, which in turn drives the sun gear 421 to rotate. The sun gear 421 transmits a rotational force to the planetary gear 422 through a meshing effect with the planetary gear 422; the planetary gear 422 drives the carrier 423 to rotate through the fixed gear ring 424. The carrier 423 drives the eccentric wheel 411 to rotate, and the eccentric wheel 411 drives the driving ring gear 412 to rotate, thereby driving the bubble mesh 32 to rotate by the driving ring gear 412 through the driven ring gear 413.

This embodiment achieves multiple decelerations of the rotation of the bubble mesh by using a planetary gear reduction mechanism and an eccentric wheel reduction mechanism, greatly reducing the vibration that may occur during the rotation of the bubble mesh and rendering the bubbles generation being more stable. Specifically, through a cooperation of the sun gear 421, the planetary gear 422, and the fixed gear ring 424, and combined with a further deceleration of the eccentric wheel 411, the driving ring gear 412, and the driven ring gear 413, the rotation of the bubble mesh 32 is smoother and the shaking is reduced.

As shown in FIGS. 3 to 5, in some embodiments of the bubble blowing device 10, the deceleration mechanism 4 further includes a connection seat 43, which is inserted and matched with the bubble mesh 32. A surface of the connection seat 43 away from the bubble mesh 32 is provided with an avoidance groove 431, the driven ring gear 413 is integrally formed and provided in the avoidance groove 431.

It can be understood that a plug-fitting of the connection seat 43 and the bubble mesh 32 enables the product to quickly disassemble the bubble mesh 32 in a short period of time, thereby improving the convenience of product maintenance. At the same time, a user can also replace different bubble meshes according to different usage needs.

The avoidance groove 431 can accommodate and limit the driven ring gear 413 and the driving ring gear 412, thereby ensuring that they can maintain stable and reliable meshing in a groove space. The driven ring gear 413 is integrally formed and provided in the avoidance groove 431, which can tightly integrate the driven ring gear 413 with the connection seat 43, thereby enhancing the structural strength and stability of the entire deceleration mechanism 4.

As shown in FIGS. 3 to 5, in some embodiments of the bubble blowing device 10, the pumping liquid mechanism 5 includes the liquid pump 51 and the liquid distribution plate 52. The liquid pump 51 is provided on the bracket 1, the liquid distribution plate 52 is located between the fan blade 31 and the bubble mesh 32. The liquid distribution plate 52 is provided with the liquid guide hole 53, and the liquid pump 51 is connected to the liquid distribution plate 52. The fixed gear ring 424 is provided on the liquid distribution plate 52.

At least one clamping part 54 is provided on the liquid distribution plate 52, and at least one clamping hole 12 is provided on the bracket 1. Each of the at least one clamping part 54 is correspondingly clamped to each of the clamping hole 12.

It can be understood that the pumping liquid mechanism 5 as a whole is an existing technology, which can be configured to support a deformation of a flexible pipe through a circulating member, so that the liquid can be transported along the flexible pipe through the deformation of the flexible pipe. The setting of the clamping part 54 enables the liquid distribution plate 52 to be quickly and stably installed on the bracket 1, thereby improving the production and assembly efficiency of the product.

It should be noted that liquid can be guided through a pipe. A connector can be provided on the liquid distribution plate 52 so as to guide the foam liquid into the liquid distribution plate 52 through the connector. There may be a plurality of clamping parts 54, and there may also be a plurality of clamping holes 12. Each clamping part 54 is tightly and corresponding clamped to each clamping hole 12.

As shown in FIGS. 3 to 5, in some embodiments of the bubble blowing device 10, the motor 2 is a dual-shaft motor, which has the torque shaft 22 and the output shaft 21. The dual-shaft motor is provided on the bracket 1. The liquid pump 51 is connected to the torque shaft 22. The liquid pump 51 is driven by the torque shaft 22 and pump the liquid to the liquid distribution plate 52, and the liquid flows through the liquid guide hole 53 to the bubble mesh 32.

It can be understood that the liquid pump 51 is driven by the torque shaft 22 to pump the liquid to the liquid distribution plate 52, and the liquid (foam liquid used for forming bubbles) flows through the liquid guide hole 53 to the bubble mesh 32. The foam liquid can form a bubble film on the bubble mesh 32, and gas flow can deform the bubble film so as to form bubbles.

The embodiments of the present disclosure has the following beneficial effects.

The present disclosure relates to a bubble blowing device, which connects the output shaft of the motor and the bubble mesh by providing with the deceleration mechanism, effectively solving the problem of vibration of the bubble mesh during rotation. Specifically, the deceleration mechanism can slow down and stabilize the speed of the bubble mesh while the output shaft is rotated at a high speed, thereby reducing the vibration phenomenon of the bubble mesh during operation and improving the smoothness and reliability of the bubble blowing device.

Furthermore, by providing the deceleration mechanism in the length extension direction of the output shaft, the torque transmission distance between the output shaft and the bubble mesh can be effectively shortened, thereby avoiding the problem of excessive vibration caused by a long torque transmission distance and further improving the smoothness and reliability of product during operation; on the other hand, it can also render the structure of the entire bubble blowing device being more compact, which is not only easy to carry, but also saves storage space.

The technical solution of the present disclosure has been described in detail with reference to the accompanying drawings in the specification. In the above embodiments, the description of each embodiment has its own emphasis. For the parts that are not described in detail in one embodiment, which can refer to the relevant descriptions of other embodiments. Those skilled in the art should also be aware that process and modules mentioned in the specification are not necessarily necessary for the present disclosure. In addition, it can be understood that the steps in the method of the embodiment of the present disclosure can be sequentially adjusted, merged, and deleted according to an actual need, and the modules in the device of the embodiment of the present disclosure can be merged, divided, and deleted according to the actual need.

The above has described various embodiments of the present disclosure. The above description is exemplary, not exhaustive, and is not limited to the disclosed embodiments. Without deviating from the scope and spirit of the various embodiments described, many modifications and changes are obvious to those skilled in the art. The selection of terms used in this specification aims to best explain the principles, practical applications, or improvements to the technology in the market of each embodiment, or to enable other skilled in the art to understand the various embodiments disclosed in the present disclosure.

What is claimed is:

1. A bubble blowing device, comprising:

a bracket;

a motor, which is provided on the bracket and comprises an output shaft;

a bubble blowing mechanism, which comprises a fan blade and a bubble mesh; the fan blade is connected to the output shaft, the bubble mesh is movably provided on the bracket;

a pumping liquid mechanism, configured to pump liquid to the bubble mesh; and a deceleration mechanism, which is provided in a length extension direction of the output shaft, the deceleration mechanism is located between the fan blade and the bubble mesh; one end of the deceleration mechanism is connected to the output shaft, and the other end of the deceleration mechanism is connected to the bubble mesh;

wherein the deceleration mechanism comprises an eccentric wheel, a driving ring gear, and a driven ring gear;

the eccentric wheel, the driving ring gear, and the driven ring gear are all located in the length extension direction of the output shaft;

the eccentric wheel is connected to the output shaft, the driving ring gear is provided on the eccentric wheel, the driven ring gear is provided on the bubble mesh, the driving ring gear is located inside the driven ring gear and meshes with the driven ring gear.

2. The bubble blowing device according to claim 1, wherein a limiting portion is provided on the driving ring gear, a limiting hole is provided on the bracket, the limiting portion is inserted into the limiting hole, and the limiting hole is configured to limit the limiting portion.

3. The bubble blowing device according to claim 1, wherein the deceleration mechanism comprises a sun gear, a planetary gear, a carrier, and a fixed gear ring;

the sun gear is sleeved on the output shaft, the planetary gear is rotatably provided on the carrier, the carrier is connected to the bubble mesh, the fixed gear ring is provided on the bracket, and the planetary gear meshes with the sun gear and the fixed gear ring respectively.

4. The bubble blowing device according to claim 3, wherein the sun gear is provided on the fan blade.

5. The bubble blowing device according to claim 3, wherein the deceleration mechanism comprises three planetary gears, each of which is respectively provided on the carrier, the sun gear meshes with each of the three planetary gears, and each of the three planetary gears meshes with the fixed gear ring.

6. The bubble blowing device according to claim 3, wherein at least one insertion shaft is provided on the carrier, and each of the at least one insertion shaft is provided with the planetary gear.

7. The bubble blowing device according to claim 3, wherein the deceleration mechanism further comprises an eccentric wheel, a driving ring gear, and a driven ring gear;

the eccentric wheel, the driving ring gear, and the driven ring gear are all located in the length extension direction of the output shaft;

the eccentric wheel is provided on the carrier, the driving ring gear is provided on the eccentric wheel, the driven ring gear is provided on the bubble mesh, the driving ring gear is located inside the driven ring gear, and the driving ring gear meshes with the driven ring gear;

when the carrier drives the eccentric wheel to rotate, the eccentric wheel drives the driving ring gear to rotate, so that the driving ring gear drives the bubble mesh to rotate through the driven ring gear.

8. The bubble blowing device according to claim 7, wherein the deceleration mechanism further comprises a connection seat, which is inserted into the bubble mesh;

a surface of the connection seat away from the bubble mesh is provided with an avoidance groove, and the driven ring gear is integrally formed and provided in the avoidance groove.

9. The bubble blowing device according to claim 1, wherein the pumping liquid mechanism comprises a liquid pump and a liquid distribution plate, the liquid pump is provided on the bracket, and the liquid pump is connected to the motor, the liquid distribution plate is provided between the fan blade and the bubble mesh, and the liquid distribution plate is provided with a liquid guide hole, the liquid pump is connected to the liquid distribution plate, the fixed gear ring is provided on the liquid distribution plate;

at least one clamping part is provided on the liquid distribution plate, at least one clamping hole is provided on the bracket; each of the at least one clamping part is correspondingly clamped to each of the at least one clamping hole.

* * * * *